US006613113B2

(12) United States Patent
Minick et al.

(10) Patent No.: US 6,613,113 B2
(45) Date of Patent: Sep. 2, 2003

(54) ABRASIVE PRODUCT AND METHOD OF MAKING THE SAME

(75) Inventors: Chris A. Minick, Stillwater, MN (US); Michael J. Annen, Hudson, WI (US); Eric W. Nelson, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 25 days.

(21) Appl. No.: 10/033,390

(22) Filed: Dec. 28, 2001

(65) Prior Publication Data

US 2003/0121212 A1 Jul. 3, 2003

(51) Int. Cl.[7] ..... B24D 3/00; B24D 3/28; B24D 11/00

(52) U.S. Cl. ..... 51/298; 51/295; 51/307; 51/308; 51/309; 51/293

(58) Field of Search ..... 51/298, 295, 307, 51/308, 309, 293

(56) References Cited

U.S. PATENT DOCUMENTS

| | | | |
|---|---|---|---|
| 2,984,052 | A | 5/1961 | Mueller, Jr. |
| 3,041,156 | A | 6/1962 | Rowse et al. |
| 3,607,159 | A | 9/1971 | Haywood |
| 3,861,892 | A | 1/1975 | Wisdom, Jr. et al. |
| 4,137,356 | A | 1/1979 | Shoemaker et al. |
| 4,255,164 | A | 3/1981 | Butkze et al. |
| 4,311,489 | A | 1/1982 | Kressner |
| 4,314,827 | A | 2/1982 | Leitheiser et al. |
| 4,355,489 | A | 10/1982 | Heyer et al. |
| 4,609,581 | A | 9/1986 | Ott |
| 4,623,364 | A | 11/1986 | Cottringer et al. |
| 4,652,274 | A | 3/1987 | Boettcher et al. |
| 4,652,275 | A | 3/1987 | Bloecher et al. |
| 4,735,632 | A | 4/1988 | Oxman et al. |
| 4,744,802 | A | 5/1988 | Schwabel |
| 4,751,138 | A | 6/1988 | Tumey et al. |
| 4,770,671 | A | 9/1988 | Monroe et al. |
| 4,799,939 | A | 1/1989 | Bloecher et al. |
| 4,881,951 | A | 11/1989 | Monroe et al. |
| 4,903,440 | A | 2/1990 | Kirk et al. |
| 4,950,696 | A | 8/1990 | Palazotto et al. |
| 4,985,340 | A | 1/1991 | Palazzotto |
| 4,997,461 | A | 3/1991 | Markhoff-Matheny et al. |
| 5,009,675 | A | 4/1991 | Kunz et al. |
| 5,011,508 | A | 4/1991 | Wald et al. |
| 5,042,991 | A | 8/1991 | Kunz et al. |
| 5,085,671 | A | 2/1992 | Martin et al. |
| 5,127,197 | A | 7/1992 | Brukvoort et al. |
| 5,213,591 | A | 5/1993 | Celikkaya et al. |
| 5,236,472 | A | 8/1993 | Kirk et al. |
| 5,254,194 | A | 10/1993 | Ott et al. |
| 5,256,170 | A | 10/1993 | Harmer et al. |
| 5,346,278 | A | 9/1994 | Dehondt |
| 5,368,619 | A | 11/1994 | Culler |
| 5,378,252 | A | 1/1995 | Follensbee |
| 5,435,816 | A | 7/1995 | Spurgeon et al. |
| 5,500,273 | A | 3/1996 | Holmes et al. |
| 5,505,747 | A | 4/1996 | Chesley |
| 5,551,960 | A | 9/1996 | Christianson |
| 5,578,343 | A | 11/1996 | Gaeta et al. |
| 5,637,386 | A | 6/1997 | Darjee |
| 5,654,078 | A | 8/1997 | Ferronato |
| 5,667,540 | A | 9/1997 | Chesley |
| 5,672,186 | A | 9/1997 | Chesley |
| 5,674,122 | A | 10/1997 | Krech et al. |
| 5,707,903 | A | 1/1998 | Schottenfeld |
| 5,975,987 | A | 11/1999 | Hoopman et al. |
| 5,975,988 | A | 11/1999 | Christianson |
| 6,024,634 | A | 2/2000 | Höglund et al. |
| 6,099,776 | A | 8/2000 | Tintelnot |
| 6,197,076 | B1 | 3/2001 | Braunschweig et al. |

FOREIGN PATENT DOCUMENTS

| | | |
|---|---|---|
| DE | 201 11 245 U1 | 6/2001 |
| WO | WO 9522436 | 8/1995 |
| WO | WO 9621539 | 7/1996 |
| WO | WO 00/38886 | 7/2000 |
| WO | WO 01/41975 A1 | 6/2001 |
| WO | WO 02/42034 A1 | 5/2002 |

*Primary Examiner*—Michael Marcheschi
(74) *Attorney, Agent, or Firm*—Richard Francis

(57) ABSTRACT

The invention provides a flexible abrasive product comprising a flexible sheet-like substrate comprising a multiplicity of separated resilient bodies connected to each other in a generally planar array in a pattern which provides open spaces between adjacent connected bodies, each body having a first surface and an opposite second surface; and abrasive particles to cause at least the first surface to be an abrasive surface. A method of making the abrasive is provided by providing the substrate and providing abrasive particles to at least the first surface to provide an abrasive surface.

39 Claims, 2 Drawing Sheets

ABRASIVE PRODUCT AND METHOD OF MAKING THE SAME

FIELD OF THE INVENTION

The present invention relates generally to flexible abrasive products which comprise an abrasive coating on a substrate which includes multiple separated but connected bodies which are spaced apart to provide openings through the substrate.

BACKGROUND OF THE INVENTION

The usual objective of any sanding operation is to remove unwanted material from the surface being sanded and to prepare that surface for subsequent coating operations. Typically, these two objectives are diametrically opposed. Removing unwanted material from the surface in a reasonable amount of time requires the use of a coarse abrasive while preparing the surface for subsequent coating operations requires the use of a fine abrasive. Thus, the operator must sand the surface multiple times with a succession of increasingly finer grit sandpaper to achieve both objectives. The coarse sandpaper removes unwanted material quickly. However, a progression of increasingly finer sandpaper is often needed to remove the unacceptably deep scratches left in the surface by the coarse sandpaper. This entire sanding process is viewed by many as laborious, time consuming, and generally distasteful. Sandpaper manufacturers recognize this dilemma and have offered many products in an attempt to solve the problem.

Conventional sandpaper is normally manufactured by adhering abrasive mineral particles to a thin relatively stiff, non-porous paper backing with a relatively inflexible adhesive. This construction yields a product with good initial stock removal (cut) but with a deep scratch pattern and the product has an undesirable relatively short life. The stock removal and deep scratch characteristics of conventional sandpaper can be attributed to the relatively stiff nature of the product. Further, the non-porous nature of the backing contributes to the short life of conventional sandpaper by trapping the debris generated during sanding. This trapped debris often clogs the abrading surface of the sandpaper preventing any further stock removal. Additionally, the thin, slippery nature of conventional sandpaper makes the product difficult to hold and use.

While such flat sandpapers are widely successfully used in a multitude of commercial applications, abrasive manufacturers such as Minnesota Mining and Manufacturing Company (3M) have recognized the above-noted deficiencies with conventional sandpaper and introduced other types of sanding products in an attempt to solve the above noted problems. 3M introduced an abrasive coated sponge under the trade designation SMALL AREA SANDING SPONGE Catalog #907, as an example of such a product. Conventional sanding sponge products are normally manufactured by adhering abrasive mineral particles to a relatively thick synthetic foam backing with a relatively flexible adhesive. The finished sanding sponge is usually between 5 mm and 25 mm thick with a non-porous abrasive surface on all major surfaces. The flexible nature of this product construction yields a finer scratch pattern in the sanded surface than conventional sandpaper when comparable grit size products are used to sand the same surface while the thickness of the construction allows easier gripping and more comfortable use. However, the flexible nature of conventional sanding sponges decreases the stock removal (cut). Like conventional sandpaper, the non-porous surface of a conventional sanding sponge traps the dust generated during sanding which may clog the abrasive surface minimizing future stock removal.

RELATED PRIOR ART

U.S. Pat. No. 2,984,052 (Mueller, Jr.) discloses coated abrasive product comprising an open, woven or knit mesh fabric having a plurality of protrubences regularly spaced throughout or regularly spaced raised areas with abrasive grains bonded thereto with the remainder of the backing sheet being free of bonded abrasive grains.

U.S. Pat. No. 5,578,343 (Gaeta et al.) discloses a mesh-backed abrasive material which comprises an unfinished greige mesh fabric in which at least 20% of the surface area is voids and which is coated with a maker coat of binder to attach abrasive grain thereto and overcoated with a size coating of binder to provide an abrasive product.

U.S. Pat. No. 5,637,386 (Darjee) discloses a coated abrasive comprising a substrate selected from woven and knit materials such as an elastic knit fabric and abrasive particles bonded directly to the substrate in a spaced discontinuous pattern.

German Utility Model No. DE 201 11 245 U1, published Jun. 21, 2001, discloses a sanding cloth made by adhering abrasive particles to a textile structure with many openings.

U.S. Pat. No. 6,099,776 (Tintelnot) discloses a flexible, open-pored cleaning body having at least one scouring surface with continuously formed raised projecting ridges of different heights which may have abrasive grain embedded therein.

Notwithstanding the above disclosures, there remains a need for a highly conformable abrasive product which will not easily become clogged with the debris created by sanding operations.

SUMMARY OF THE INVENTION

The present invention provides a flexible abrasive product which is easily conformable to contoured surfaces being abraded, easily held by hand and may be used with sanding devices, yet will not easily clog with the debris created by typical abrading operations.

In one aspect the invention provides a flexible abrasive product comprising:

a. a flexible sheet-like substrate comprising a multiplicity of separated resilient bodies connected to each other in a generally planar array in a pattern which provides open spaces between adjacent connected bodies, each body having a first surface and an opposite second surface; and b. abrasive particles to cause at least said first surface to be an abrasive surface.

Preferred flexible abrasive products include bodies which are generally square and bodies wherein the first surface is a convex surface. Preferred resilient bodies are comprised of an elastomeric material such as foam rubber composition.

The preferred manner in which to provide the abrasive surface is by coating the first surface with a curable make binder coating, applying abrasive grains to the uncured make binder coating and at least partially curing the make binder coating. A preferred embodiment includes applying a size coating over the make binder coating and abrasive particles and fully curing the coatings to firmly adhere the abrasive particles in the abrasive coating.

In a further aspect, the invention provides a method for making a flexible abrasive product comprising:

a. providing a flexible sheet-like substrate comprising a multiplicity of separated resilient bodies connected to each other in a generally planar array in a pattern which provides open spaces between adjacent connected bodies, each body having a first surface and an opposite second surface; and b. providing abrasive particles to at least said first surface to provide an abrasive surface.

A preferred method of providing the abrasive surface is provided by coating the first surface with a make coating of curable binder composition, depositing abrasive particles onto the make coating of the curable composition and at least partially curing the make coating composition. It is also preferred to coat the make coating and abrasive particles with a size coating of a curable composition and curing the size coating composition.

An alternate preferred method of providing abrasive particles to the first surface is by mixing abrasive particles with a curable binder composition to provide a mixture which cures to provide an abrasive coating, coating the first surface with the mixture and curing the curable binder composition. Preferably, after coating but prior to curing, the curable binder composition containing abrasive particles is contacted with a surface of a tool which includes raised areas and depressed areas to provide a shaped or structured surface to the abrasive coating.

The above method of providing a shaped or structured abrasive coating is described in U.S. Pat. No. 5,435,816 assigned to the same assignee as the present patent application. This patent is incorporated herein by reference.

The present invention provides an abrasive article that has an improved cut-rate. "Cut-rate" refers to the ability of an abrasive product to remove material or surface particles from the surface of a workpiece. The cut-rate is the amount of weight loss from the workpiece per unit of time. The abrasive product of the invention also has an improved scratch pattern when compared to the scratch pattern of conventional sandpaper or conventional sanding sponges. These results are surprising and unexpected for a number of reasons.

First, the surface of flexible abrasive article of the invention has an abrading surface which is non-continuous because the article is composed of a multitude of small separate typically rectangular resilient bodies (or pillows) connected to each other at corners to form an open mat. The resilient bodies are arranged in a generally checkerboard pattern such that a small open space (typically approximately the same size as the resilient bodies) is adjacent to each side of the bodies. Once coated with abrasive mineral, this arrangement results in an abrasive article with an abrasive surface having a relatively large total abrasive area separated on individual body surfaces by openings to provide a somewhat smaller total open area. By contrast, conventional sandpaper is typically coated on a continuous backing composed of approximately 100% abrasive surface and 0% open space. One skilled in the art of sandpaper would expect the cut-rate of the flexible abrasive article of the present invention to be less than the cut-rate of conventional sandpaper by virtue of the fact that conventional sandpaper contains a continuous abrasive surface. Surprisingly, this is not the case. It has been found in paint sanding tests that the product of the invention is substantially equivalent to or slightly better in cut-rate than conventional sandpaper. This surprising result may be explained by the anti-clogging nature of the open flexible abrasive article of the invention because of the openness which permits easy removal of swarf. "Swarf" refers to the fine particles that are created during the abrading process.

The open spaces adjacent to each resilient bodies serve as reservoirs to collect the dust generated during the sanding process, effectively removing the sanding dust from the abrasive surface, resulting in less abrasive surface clogging and higher stock removal than expected.

Second, the foam-like nature of the flexible substrate of the abrasive article of the present invention provides a fine scratch pattern in the sanded surface. Abrasive minerals coated on foam-like backings will leave a finer scratch pattern in the sanded surface than conventional sandpaper having abrasive of comparable grit size. One skilled in the art of sandpaper would not expect the scratch finish pattern left in the sanded surface by the present invention to be substantially different from that left by a conventional sanding sponge of comparable grit size. Surprisingly, the results of the scratch finish testing of the abrasive article of the present invention and a conventional sanding sponge demonstrate that a significantly finer scratch pattern is left in the sanded surface by the flexible abrasive article of the invention than a conventional sanding sponge of comparable abrasive grit. These results can be explained by the checkerboard arrangement of small abrasive coated resilient bodies. Each of the abrasive coated resilient bodies is essentially a small sanding sponge which collectively provide a unique unexpected result. However, the checkerboard arrangement of the abrasive coated resilient bodies also contributes to the fine finish left in the sanded surface. Since each abrasive coated resilient body is connected to an adjacent abrasive coated resilient body with an inherently flexible joint, each abrasive coated resilient body is free to follow a slightly different path across the sanded surface. This results in multiple, overlapping sanding paths with a fine scratch finish. The multitude of small resilient bodies in the flexible abrasive product of the invention result in a multitude of sanding paths when the abrasive article is deployed over the surface being abraded. Many of the individual sanding paths will overlap each other during the surface finishing process yielding an unexpectedly fine sanding scratch pattern.

DEFINITION OF TERMS

"flexible" in reference to the flexible abrasive product of the invention means that the abrasive product is sufficiently conformable to be folded over on itself without permanent deformation and will substantially redeploy to its original structure when unfolded.

"resilient" with reference to the resilient bodies is intended to refer to the material from which the bodies are formed which is sufficiently compressible to be deformed under pressure yet will return to its original configuration when the pressure is removed.

"convex" in reference to the preferred configuration of the first surface of the resilient bodies is intended to indicate that the first surface has a high point which is distally spaced from the peripheral surface adjacent the edges of the resilient body on the same side.

"acrylate" and "polyfunctional acrylate" are meant to include substituted acrylates such as methacrylates as well. "actinic radiation" means non-particulate radiation having a wavelength within the range of 200 to 700 nanometers.

"average acrylate functionality" refers to the average number of acryloxy groups per molecule; it is determined by dividing the total number of acryloxy groups in the polyfunctional acrylate by the total number of molecules of polyfunctional acrylate.

"average epoxy functionality" refers to the average number of epoxy groups per molecule; it is determined by dividing the total number of epoxy groups in the epoxy resin by the total number of epoxy resin molecules.

"bireactive compounds" are those which contain at least one ethylenically-unsaturated group and at least one 1,2-epoxide group.

"epoxy resin" refers to a composition comprising at least one compound having at least one epoxy group.

"epoxy group" refers to an oxiranyl group.

"monofunctional acrylate" refers to a compound having one acryloxy group per molecule.

"photoinitiator" refers to a substance which, when exposed to light, is capable of polymerizing polymerizable groups; the polymerization may be free radical or cationic in nature.

"polyfunctional acrylate" refers to a compound having an acryloxy functionality of greater than 1.

"polyol" refers to a compound having a hydroxyl functionality greater than 1.

DETAILED DESCRIPTION OF THE INVENTION

Figure 1:
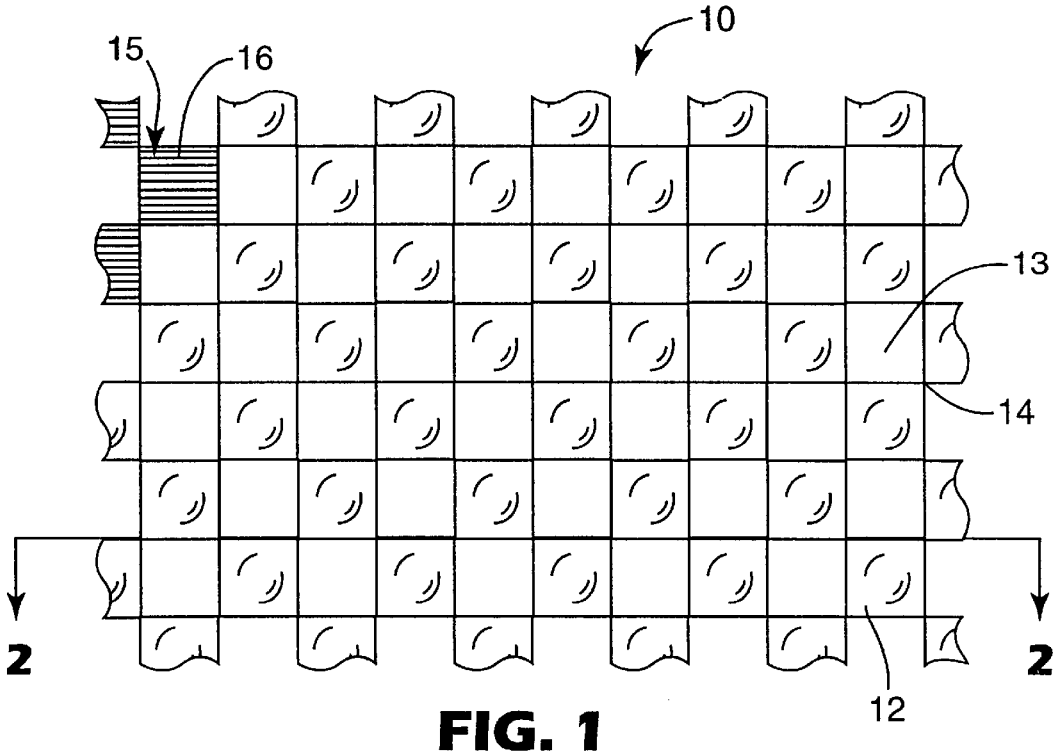
FIG. 1 is a schematic representation of a plane view of the flexible abrasive product according to the present invention which has parts cut away to reveal details of its scrim supporting structure.
Figure 2:
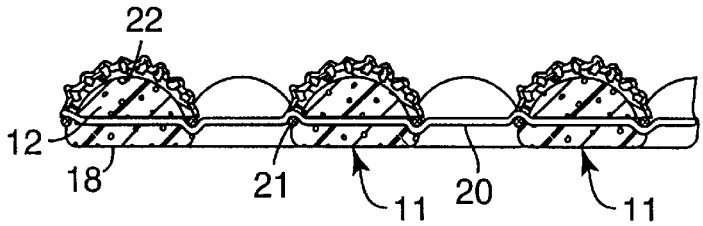
FIG. 2 is an enlarged schematic cross sectional drawn representation of a portion of the flexible abrasive product according to the present invention depicted in FIG. 1 taken at Line 2—2 of FIG. 1.

As depicted in FIG. 1 and FIG. 2, the flexible abrasive product of 10 of the invention includes a substrate 11 which comprises a plurality of separated resilient bodies 12 which are held together in a pattern so as to provide openings 13 between each adjacent separated body 12 yet are connected to one another at contact points 14. While substrate 11 may be provided by appropriate die cutting of a solid sheet of rubber or a sheet of foam material, the preferred substrate 11 preferably includes a scrim including parallel threads 20 and cross-parallel threads 21 typically in a grid pattern which provides openings, every other one of which is closed by a resilient body in an offset pattern as depicted in FIG. 1. While the scrim may be open in the open areas containing the resilient bodies, such areas preferably contain a substructure 15 of parallel fibers 16 which would be deployed within the resilient body to provide further reinforcement.

Such substrates are formed by dipping a scrim into a liquid which is curable to form a polyvinylchloride (PVC) foam and curing by placing the dipped scrim in an oven which causes the composition to expand and solidify. These substrates are well known and commercially available under the tradenames OMNI-GRIP, MAXI-GRIP, ULTRA GRIP, EIRE-GRIP, and LOC-GRIP from Griptex Industries, Inc. of Calhoun, Ga. These products may be made according to U.S. Pat. No. 5,707,903 (Schottenfeld), incorporated herein by reference.

Certain of these commercial substrates may be adversely altered by heating to cure binder precursors which require elevated cure temperatures. Certain cycloaliphatic epoxy binder precursors, which require a lower temperature cure, have been found to avoid this problem. Examples of useable thermosetting resinous adhesives suitable for use in making the products of this invention include, without limitation, epoxy resins, vinyl ether resins, acrylate resins, acrylated isocyanurate resins, acrylated urethane resins, acrylated epoxy resins, and combinations thereof. A preferred radiation-curable binder precursor is a cycloaliphatic epoxy resin. Examples of such cycloaliphatic epoxy binder precursors include those available under the Dow Chemical Company trade designations ERL 4299, a bis-3,4 hexyl methyl cycloaliphatic epoxy resin, and ERL 4221, a cycloaliphatic epoxy resin, both being available from Dow Chemical, Midland, Mich.

The scrim may be made of natural or synthetic fibers which may be either knitted or woven in a network having intermittent openings spaced along the surface of the scrim. The scrim need not be woven in a uniform pattern but may also include a nonwoven random pattern. Thus, the openings may either be in a pattern or randomly spaced. The scrim network openings may be rectangular or they may have other shapes including a diamond shape, a triangular shape, an octagonal shape or a combination of these shapes.

Preferably the scrim comprises a first set of rows of separated fibers deployed in a first direction and a second set of fibers deployed in a second direction to provide a grid including multiple adjacent openings wherein resilient bodies are located in alternate openings with openings between resilient bodies being devoid of resilient bodies. The scrim may also comprise an open mesh selected from the group consisting of woven or knitted fiber mesh, synthetic fiber mesh, natural fiber mesh, metal fiber mesh, molded thermoplastic polymer mesh, molded thermoset polymer mesh, perforated sheet materials, slit and stretched sheet materials and combinations thereof.

The composition of the resilient bodies may either be foamed or non-foamed and may be composed of any of other variety of elastomeric materials including, but not limited to, polyurethane resins, polyvinyl chloride resins, ethylene vinyl acetate resins, synthetic or natural rubber compositions, acrylate resins and other suitable elastomeric resin compositions.

The substrate is characterized by having openness between resilient bodies to provide a cumulative openness as compared to the total area of the resilient body on the order of about 20% to about 80%, more preferably, between about 30% to about 60%.

The substrate has a sufficient thickness to make it convenient for being hand held. The thickness is measured between the highest point of the first surface of the resilient body to the second surface of the resilient body. The thickness preferably is between about 1 mm and about 15 mm, more preferably about 3 mm to about 10 mm.

While a square or rectangular shape of the resilient body is preferred, the body may be any convenient geometric shape including, but not limited to, square, rectangular, triangular, circular, and in the shape of a polygon. The resilient bodies are preferably uniform in shape, but they need not be. The resilient bodies may be aligned in rows longitudinally and in a transverse direction but for some applications it may be preferable that they not be aligned because in sanding operations where the abrasive product is moved in only one direction, for example, the longitudinal direction, longitudinally aligned abrasive covered resilient bodies could produce an unwanted scratch pattern in the surface being abraded.

The dimensions of the resilient bodies may vary from about 2 to about 25 mm, preferably from 5 to 10 mm. "Each dimension" refers to the dimension of a side, if rectangular, the diameter, if circular or the maximum dimension if of an irregular shape. The shapes of the resilient bodies need not be a defined shaped but could be randomly shaped. When referring to the dimensions of the resilient body, the dimensions are intended to include the widths in the longitudinal or transverse direction or the maximum dimension of the body when measured from one side to the other notwithstanding any direction.

The openings in the substrate are generally individually smaller than the adjacent resilient body and may have dimensions on the order of about 2 mm to about 25 mm, preferably of about 5 mm to about 10 mm. The openings may be somewhat rectangular, if the resilient bodies are rectangular or they may take any other configuration depending on the shape of the adjacent resilient bodies. The shape of the openings is typically defined by the shape of the edges of the resilient bodies. The resilient bodies and the openings are generally uniformly distributed throughout the entire area of the flexible abrasive product of the invention but this is not necessary in all cases.

Referring now to FIG. 2, there is shown an enlarged schematic cross sectional drawn representation of the abrasive product of the present invention including resilient body 12 which includes a first surface 22 which is preferably convex or domed and a second surface 18 which is preferably flat, if the abrasive product is to be attached to one part of a two-part mechanical fastening device such as a hook or loop part of a hook and loop fastening system. If the abrasive product will not be attached to an attachment system, the second surface 18 need not be flat and it may have any other configuration. The second surface 18 may also be an abrasive surface, in which case it may also be convex. The collection of second surfaces 18 provides an easily handleable backside of the abrasive product of the invention which conforms easily to the hand to provide a convenient deformable product which is easily utilized to abrade articles which have a complex shape.

Abrasive Coating

The invention provides coated abrasive products comprising an abrasive layer coated on the substrate described above. The abrasive layer can be provided by any known means, i.e., drop coating, slurry coating, electrostatic coating, roll coating, etc. The abrasive coating is typically applied to just one side of the substrate, but may be applied to both sides. If applied to both sides, the abrasive particle size may be the same for each side or may be different for each side.

Once the substrate is provided, the introduction of abrasive particles and several adhesive layers, which are typically applied in binder precursor form, is contemplated in the context of forming the abrasive layer of the coated abrasive product.

Make Coat

The make coat is formed by applying a make coat precursor to the substrate. "make coat precursor" refers to the coatable resinous adhesive material applied to the coatable surface of the first surface of the resilient bodies of the substrate to secure abrasive particles thereto. "Make coat" refers to the layer of hardened resin over the coatable surfaces of the bodies of the substrate formed by hardening the make coat precursor. Typically the thickness of the make coat adhesive is adjusted so that between 90% and 60% of the individual grain length protrudes above the cured make adhesive layer. Generally, larger grit minerals (smaller grit numbers) require more make adhesive than smaller grit minerals (larger grit numbers).

The make coat precursor is applied to the substrate at a coating weight which, when cured, provides the necessary adhesion to securely bond the abrasive particles to the coatable surfaces of the substrate. For typical make coats, the dry add-on weight will range from about 60 to 200 g/m$^2$.

A make coat is applied to one side of the substrate. The make coat binder precursor can be coated by any conventional technique, such as knife coating, spray coating, roll coating, rotogravure coating, and the like.

The adhesive layers in the coated abrasive articles of the present invention used variously as make, size and supersize coats, typically are formed from a resinous adhesive. Each of the layers can be formed from the same or different resinous adhesives. Useful resinous adhesives are those that are compatible with the organic polymeric material of the substrate. Cured resinous adhesives are also tolerant of grinding conditions such that the adhesive layers do not deteriorate and prematurely release the abrasive material.

The resinous adhesive is preferably a layer of a thermosetting resin. Examples of useable thermosetting resinous adhesives suitable for this invention include, without limitation, phenolic resins, aminoplast resins, urethane resins, epoxy resins, epoxy-polyol resins, ethylenically unsaturated resins, acrylate resins, acrylated isocyanurate resins, urea-formaldehyde resins, isocyanurate resins, polyvinyl chloride resins, butadiene rubber resins, acrylated urethane resins, acrylated epoxy resins, or combinations thereof. A preferred make coat resin is a cycloaliphatic epoxy resin combined with a polyol.

The make, size coats and supersize layers, respectively, may contain other materials that are commonly utilized in coated abrasive products. These materials, referred to as additives, include grinding aids, fillers, coupling agents, wetting agents, dyes, pigments, plasticizers, release agents, or combinations thereof. One would not typically use more of these materials than needed for desired results. Fillers are typically present in no more than an amount of about 90 wt %, for either the make or size coat, based upon the weight of the adhesive. Examples of useful fillers include calcium salts, such as calcium carbonate and calcium metasilicate, silica, metals, carbon, or glass.

Abrasive Particles

The abrasive particles suitable for this invention include fused aluminum oxide, heat treated aluminum oxide, alumina-based ceramics, silicon carbide, zirconia, alumina-zirconia, garnet, diamond, ceria, cubic boron nitride, ground glass, quartz, titanium diboride, sol gel abrasives and combinations thereof. Examples of sol gel abrasive particles can be found in U.S. Pat. No. 4,314,827 (Leitheiser et al.); U.S. Pat. No. 4,623,364 (Cottringer et al); U.S. Pat. No. 4,744,802 (Schwabel); U.S. Pat. No. 4,770,671 (Monroe et al.) and U.S. Pat. No. 4,881,951 (Wood et al.), all incorporated herein after by reference. The abrasive particles can be either shaped (e.g., rod, triangle, or pyramid) or unshaped (i.e., irregular). The term "abrasive particle" encompasses abrasive grains, agglomerates, or multi-grain abrasive granules.

Examples of such agglomerates are described in U.S. Pat. No. 4,652,275 (Bloecher, et al.) and U.S. Pat. No. 5,975,988 (Christianson) and assigned to the assignee of the present invention, each being incorporated herein by reference. The agglomerates can be irregularly shaped or have a precise shape associated with them, for example, a cube, pyramid, truncated pyramid, or a sphere. An agglomerate comprises abrasive particles or grains and a bonding agent. The bonding agent can be organic or inorganic. Examples of organic binders include phenolic resins, urea-formaldehyde resins, and epoxy resins. Examples of inorganic binders include metals (such as nickel), and metal oxides. Metal oxides are usually classified as either a glass (vitrified), ceramic (crystalline), or glass-ceramic. Further information on ceramic agglomerates is disclosed in U.S. Pat. No. 5,975,988 (Christianson) assigned to the assignee of the present invention.

Useful aluminum oxide grains for applications of the present invention include fused aluminum oxides, heat treated aluminum oxides, and ceramic aluminum oxides. Examples of such ceramic aluminum oxides are disclosed in U.S. Pat. No. 4,314,827 (Leitheiser, et al.), U.S. Pat. No. 4,744,802 (Schwabel), U.S. Pat. No. 4,770,671 (Monroe, et al.), and U.S. Pat. No. 4,881,951 (Wood, et al.).

Abrasive particles can be coated with materials to provide the particles with desired characteristics. For example, materials applied to the surface of an abrasive particle have been shown to improve the adhesion between the abrasive particle and the polymer. Additionally, a material applied to the surface of an abrasive particle may improve the dispersibility of the abrasive particles in the precursor polymer subunits. Alternatively, surface coatings can alter and improve the cutting characteristics of the resulting abrasive particle. Such surface coatings are described, for example, in U.S. Pat. No. 5,011,508 (Wald et al.); U.S. Pat. No. 3,041,156 (Rowse et al.); U.S. Pat. No. 5,009,675 (Kunz et al.); U.S. Pat. No. 4,997,461 (Markhoff-Matheny et al.); U.S. Pat. No. 5,213,591 (Celikkaya et al.); 5,085,671 (Martin et al.) and U.S. Pat. No. 5,042,991 (Kunz et al.), the disclosures of which are incorporated herein by reference.

The average particle size of the abrasive particle for advantageous applications of the present invention is at least about 0.1 micrometer, preferably at least about 65 micrometers. A particle size of about 100 micrometers corresponds approximately to a coated abrasive grade 150 abrasive grain, according to American National Standards Institute (ANSI) Standard B74.18-1984. The abrasive grain can be oriented, or it can be applied to the substrate without orientation, depending upon the desired end use of the flexible abrasive product.

The abrasive particles can be embedded into the make coat precursor by any conventional technique such as electrostatic coating or drop coating. During electrostatic coating, electrostatic charges are applied to the abrasive particles and this propels the abrasive particles upward. Electrostatic coating tends to orient the abrasive particle, which generally leads to better abrading performance. In drop coating, the abrasive particles are forced from a feed station and fall into the binder precursor by gravity. It is also within the scope of this invention to propel the abrasive particles upward by a mechanical force into the binder precursor.

If the abrasive particles are applied by electrostatic coating, then it is preferred that the backing be placed on a drum. The drum serves as a ground for the electrostatic coating process. The proper amount of abrasive particles is then placed on a plate underneath the drum. Next, the drum is rotated and the electrostatic field is turned on. As the drum rotates, the abrasive particles are embedded into the make coat. The drum is rotated until the desired amount of abrasive particles is coated. The resulting construction is then exposed to conditions sufficient to solidify the make coat.

Alternately, a charged plate can be used as the ground for the electrostatic process instead of the drum.

Size Coat

The size coat is a thin layer of adhesive applied over the mineral and the make coat. The purpose of this adhesive layer is to bind the individual mineral particles together so they all act in unison during the sanding process. The thickness of the size adhesive layer varies with individual mineral grain sizes. Coarser minerals (smaller grit numbers) require more size adhesive than finer minerals (larger grit numbers). The size coat is formed by applying a thin layer of a size coat precursor over the make coat and abrasive particles, thereby to form a thin hard size coat having a dry add-on weight of less than approximately 60 $g/m^2$. Preferably, the size coat add-on weight is about 8 to 30 $g/m^2$. It has been found that when such a thin hard size coat is applied to an elongatable foam substrate, the thin hard size coat has a reduced tendency to tear the foam substrate when flexed, but maintains the improved performance characteristics associated with a thick hard size coat, namely increased life, cut, and wear resistance. Further details of the steps needed to obtain the improved performance characteristics may be found in WO 01/41975 A1, incorporated herein by reference.

A size coat may be applied over the abrasive particles and the make coat such as by roll coating or spray coating. Preferably, the abrasive coating also includes a size coating over the make coating and abrasive particles. The size coating preferably is a binder resin selected from the group consisting of phenolic resins, aminoplast resins having pendant $\alpha,\beta$-unsaturated carbonyl groups, urethane resins, epoxy resins, ethylenically unsaturated resins, acrylated isocyanurate resins, urea formaldehyde resins, isocyanurate resins, acrylated urethane resins, acrylated epoxy resins, bis-maleimide resins, fluorene-modified resins, and combinations thereof. The preferred size coat is a mixture of cycloaliphatic epoxy resin and acrylate resin. After the size coat is applied, the size coat is solidified, typically upon exposure to an energy source. These energy sources include both thermal and radiation energy.

Supersize Coat

In some instances it may be preferred to apply a supersize coat over the size coat. The optional supersize coat can preferably include a grinding aid, to enhance the abrading characteristics of the coated abrasive. Examples of grinding aids include potassium tetrafluoroborate, cryolite, ammonium cryolite, or sulfur. One would not typically use more of a grinding aid than needed for desired results. The supersize coat may comprise a binder and a grinding aid.

General Method of Making

Flexible abrasive product is made by providing a flexible sheet-like substrate. A first surface of the sheet substrate is coated with a make coating formulation comprising a curable binder composition. This can be applied by a high pressure spray gun or a roll coater. The coating station can be any conventional coating means such as drop die coater, knife coater, curtain coater, vacuum die coater or a die coater. During coating, the formation of air bubbles is preferably minimized. Abrasive particles are deposited onto the make coating of the curable composition.

Energy is transmitted into the curable abrasive composite layer by an energy source to at least partially cure the make coat. The selection of the energy source will depend in part upon the chemistry of the precursor make coat. The energy source should not appreciably degrade the substrate. Partial cure of the precursor make coat means that the precursor make coat is polymerized to such a state that the curable abrasive composite layer does not flow when inverted.

The energy source may be a source of thermal energy or radiation energy, such as electron beam, ultraviolet light, or visible light. The amount of energy required depends on the chemical nature of the reactive groups in the precursor polymer subunits, as well as upon the thickness and density of the binder slurry. For thermal energy, an oven temperature of from about 75° C. to about 150° C. and a duration of from about 5 minutes to about 60 minutes are generally sufficient. Electron beam radiation or ionizing radiation may be used at an energy level of about 0.1 to about 10 Mrad, preferably at an energy level of about 1 to about 10 Mrad. Ultraviolet radiation includes radiation having a wavelength within a range of about 200 to about 400 nanometers, preferably within a range of about 250 to 400 nanometers. Visible radiation includes radiation having a wavelength within a range of about 400 to about 800 nanometers, preferably in a range of about 400 to about 550 nanometers.

A size coating formulation comprising a curable binder composition is coated over the abrasive particles and the size binder composition is cured either by heat, electron beam or UV curing.

Method of Making Shaped Abrasive Coating

Figure 3:
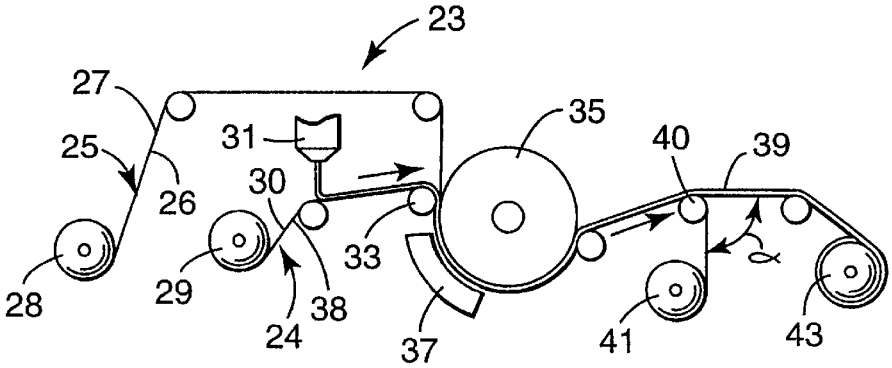
FIG. 3 is a schematic representation of the one method for making an abrasive article which may be made according to the present invention.

The manufacture of this type of product may be accomplished by utilization of the equipment schematically shown in FIG. 3. FIG. 3 illustrates an apparatus 23 for applying a shaped coating to the first major surface of the foam backing 25. A production tool 24 is in the form of belt having a cavity-bearing contacting surface 30, opposite backing surface 38, and appropriately sized cavities within contacting surface 30. Backing 25 having a first major surface 26 and a second major surface 27 is unwound from roll 28. At the same time backing 25 is unwound from roll 28, the production tool 24 is unwound from roll 29. The contacting surface 30 of production tool 24 is coated with a mixture of abrasive particles and binder precursor at coating station 31. The mixture may be heated to lower the viscosity prior to or during the coating step. The coating station can comprise any conventional coating means, such as knife coater, drop die coater, curtain coater, vacuum die coater, or an extrusion die coater. After contacting surface 30 of production tool 24 is coated, the backing 25 and the production tool 24 are brought together such that the mixture wets the first major surface 26 of the backing 25. In FIG. 3 the mixture is forced into contact with the backing 25 by means of a contact nip roll 33, which also forces the production tools/mixture/backing construction against a support drum 35. Next, a sufficient dose of radiation energy is transmitted by a source of radiation energy 37 through the back surface 38 of production tool 24 and into the mixture to at least partially cure the binder precursor, thereby forming a shaped, handleable structure 39. The production tool 24 is then separated from the shaped, handleable structure 39. Separation of the production tool 24 from the shaped, handleable structure 39 occurs at roller 40. The angle, alpha, between the shaped, handleable structure 39 and the production tool 24 immediately after passing over roller 40 is preferably a steep angle, e.g., in excess of 30 degrees, in order to bring about clean separation of the shaped, handleable structure 39 from the production tool 24. The production tool 24 is rewound as roll 41. The shaped, handleable structure 39 is wound as roll 43. If the binder precursor has not been fully cured, it can then be fully cured by exposure to an additional energy source, such as a source of thermal energy or an additional source of radiation energy, to form the coated abrasive article. Alternatively, full cure may eventually result without the use of an additional energy source to form the coated abrasive article. As used herein, the phrase "full cure" means that the binder precursor is sufficiently cured so that the resulting product will function as an abrasive article, e.g., a coated abrasive article.

The cured abrasive article made by use of the equipment depicted in FIG. 3 has a relatively smooth surface except for the surface undulations imparted by the production tool 24.

Production Tool

Figure 4:
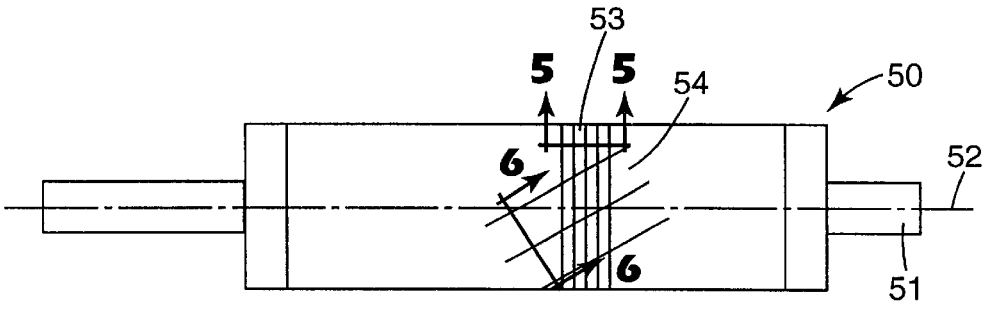
FIG. 4 is a top plane view of a roller for making a production tool useful for making an abrasive article which may be made according to the method of the present invention.

FIG. 4 shows a roller 50 that was used to make production tool 24 as depicted in FIG. 3. The following specific embodiment of roller 50 was used to make production tool 24 which was then used to make the abrasive composite structure of the present invention. Roller 50 has a shaft 51 and an axis of rotation 52. In this case the patterned surface includes a first set 53 of adjacent circumferential grooves around the roller and a second set 54 of equally spaced grooves deployed at an angle of 30° with respect to the axis of rotation 52.

Figure 5:
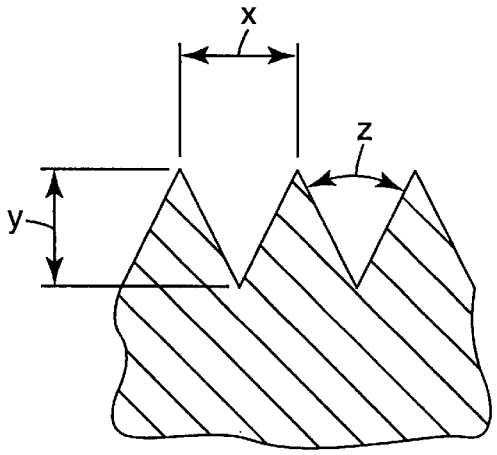
FIG. 5 is an enlarged sectional view of one segment of the roll depicted in FIG. 4 taken at line 5—5 to show surface detail.

FIG. 5 shows an enlarged cross sectional view of a segment of the patterned surface of roller 50 taken at line 5—5 in FIG. 4 perpendicular to the grooves in set 53. FIG. 5 shows the patterned surface has peaks spaced by distance x which is 54.8 $\mu$m apart peak to peak and a peak height, y, from valley to peak of 55 $\mu$m, with an angle z which is 53°.

Figure 6:
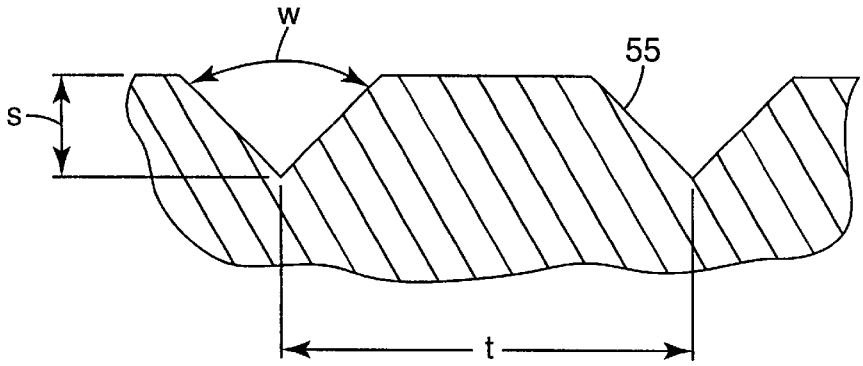
FIG. 6 is an enlarged sectional view of another segment of the patterned surface of the roll depicted in FIG. 4, taken at line 6—6.

FIG. 6 shows an enlarged cross sectional view of a segment of the patterned surface of roller 50 taken at line 6—6 in FIG. 4 perpendicular to the grooves in set 54. FIG. 6 shows grooves 55 having an angle w which is a 99.5° angle between adjacent peak slopes and valleys separated by a distance t which is 250 $\mu$m and a valley depth s which is 55 $\mu$m.

Roller 50 may also be used to make a production tool for forming the shaped structures in the abrasive layer of the abrasive product depicted in FIG. 2, according to the method described in U.S. Pat. No. 5,435,816 (Spurgeon et al.), which is incorporated herein by reference.

A production tool is used to provide an abrasive composite layer with an array of either precisely or irregularly shaped abrasive composite structures. A production tool has a surface containing a plurality of cavities. These cavities are essentially the inverse shape of the abrasive composite structures and are responsible for generating the shape and placement of the abrasive composite structures. These cavities may have any geometric shape that is the inverse shape to the geometric shapes suitable for the abrasive composites. Preferably, the shape of the cavities is selected such that the surface area of the abrasive composite structure decreases away from the backing.

The production tool can be a belt, a sheet, a continuous sheet or web, a coating roll such as a rotogravure roll, a sleeve mounted on a coating roll, or die. The production tool can be composed of metal, (e.g., nickel), metal alloys, or plastic. The metal production tool can be fabricated by any conventional technique such as photolithography, knurling, engraving, hobbing, electroforming, diamond turning, and the like. Preferred methods of making metal master tools are described in U.S. Pat. No. 5,975,987 (Hoopman et al.).

A thermoplastic tool can be replicated off a metal master tool. The master tool will have the inverse pattern desired for the production tool. The master tool is preferably made out of metal,. e.g., a nickel-plated metal such as aluminum, copper or bronze. A thermoplastic sheet material optionally can be heated along with the master tool such that the thermoplastic material is embossed with the master tool pattern by pressing the two together. The thermoplastic material can also be extruded or cast onto the master tool and then pressed. The thermoplastic material is cooled to a nonflowable state and then separated from the master tool to produce a production tool. The production tool may also contain a release coating to permit easier release of the abrasive article from the production tool. Examples of such release coatings include silicones and fluorochemicals.

Suitable thermoplastic production tools are reported in U.S. Pat. No. 5,435,816 (Spurgeon et al.), incorporated herein by reference. Examples of thermoplastic materials useful to form the production tool include polyesters, polypropylene, polyethylene, polyamides, polyurethanes, polycarbonates, or combinations thereof. It is preferred that the thermoplastic production tool contain additives such as anti-oxidants and/or UV stabilizers. These additives may extend the useful life of the production tool.

The components of the abrasive product which is made in accordance with the method of the present invention are herein described.

Abrasive Particles

An abrasive article of the present invention typically comprises at least one abrasive composite layer that includes a plurality of abrasive particles dispersed in precursor polymer subunits. The binder is formed from a binder precursor comprising precursor polymer subunits. The abrasive particles may be uniformly dispersed in a binder or alternatively the abrasive particles may be non-uniformly dispersed therein. It is preferred that the abrasive particles are uniformly dispersed in the binder so that the resulting abrasive article has a more consistent cutting ability.

The average particle size of the abrasive particles can range from about 0.01 to 1500 micrometers, typically between 0.01 and 500 micrometers, and most generally between 1 and 100 micrometers. The size of the abrasive particle is typically specified to be the longest dimension of the abrasive particle. In most cases there will be a range distribution of particle sizes. In some instances it is preferred that the particle size distribution be tightly controlled such that the resulting abrasive article provides a consistent surface finish on the workpiece being abraded.

Examples of conventional hard abrasive particles include fused aluminum oxide, heat treated aluminum oxide, white fused aluminum oxide, black silicon carbide, green silicon carbide, titanium diboride, boron carbide, tungsten carbide, titanium carbide, diamond (both natural and synthetic), silica, iron oxide, chromia, ceria, zirconia, titania, silicates, tin oxide, cubic boron nitride, garnet, fused alumina zirconia, sol gel abrasive particles and the like. Examples of sol gel abrasive particles can be found in U.S. Pat. No. 4,314,827 (Leitheiser et al.); U.S. Pat. No. 4,623,364 (Cottringer et al); U.S. Pat. No. 4,744,802 (Schwabel); U.S. Pat. No. 4,770,671 (Monroe et al.) and U.S. Pat. No. 4,881,951 (Wood et al.), all incorporated hereinafter by reference.

The term abrasive particle, as used herein, also encompasses single abrasive particles bonded together with a polymer to form an abrasive agglomerate. Abrasive agglomerates are further described in U.S. Pat. No. 4,311,489 (Kressner); U.S. Pat. No. 4,652,275 (Bloecher et al.); U.S. Pat. No. 4,799,939 (Bloecher et al.), and U.S. Pat. No. 5,500,273 (Holmes et al.). Alternatively, the abrasive particles may be bonded together by inter particle attractive forces.

The abrasive particle may also have a shape associated with it. Examples of such shapes include rods, triangles, pyramids, cones, solid spheres, hollow spheres and the like. Alternatively, the abrasive particle may be randomly shaped.

Abrasive particles can be coated with materials to provide the particles with desired characteristics. For example, materials applied to the surface of an abrasive particle have been shown to improve the adhesion between the abrasive particle and the polymer. Additionally, a material applied to the surface of an abrasive particle may improve the dispersibility of the abrasive particles in the precursor polymer subunits. Alternatively, surface coatings can alter and improve the cutting characteristics of the resulting abrasive particle. Such surface coatings are described, for example, in U.S. Pat. No. 5,011,508 (Wald et al.); U.S. Pat. No. 3,041,156 (Rowse et al.); U.S. Pat. No. 5,009,675 (Kunz et al.); U.S. Pat. No. 4,997,461 (Markhoff-Matheny et al.); U.S. Pat. No. 5,213,591 (Celikkaya et al.); U.S. Pat. No. 5,085,671 (Martin et al.) and U.S. Pat. No. 5,042,991 (Kunz et al.), the disclosures of which are incorporated herein by reference.

Fillers

An abrasive article of this invention may comprise an abrasive coating which further comprises a filler. A filler is a particulate material with an average particle size range between 0.1 to 50 micrometers, typically between 1 to 30 micrometers. Examples of useful fillers for this invention include metal carbonates (such as calcium carbonate, calcium magnesium carbonate, sodium carbonate, magnesium carbonate), silica (such as quartz, glass beads, glass bubbles and glass fibers), silicates (such as talc, clays, montmorillonite, feldspar, mica, calcium silicate, calcium metasilicate, sodium aluminosilicate, sodium silicate), metal sulfates (such as calcium sulfate, barium sulfate, sodium sulfate, aluminum sodium sulfate, aluminum sulfate), gypsum, vermiculite, sugar, wood flour, aluminum trihydrate, carbon black, metal oxides (such as calcium oxide, aluminum oxide, tin oxide, titanium dioxide), metal sulfites (such as calcium sulfite), thermoplastic particles (such as polycarbonate, polyetherimide, polyester, polyethylene, polysulfone, polystyrene, acrylonitrile-butadiene-styrene block copolymer, polypropylene, acetal polymers, polyurethanes, nylon particles) and thermosetting particles (such as phenolic bubbles, phenolic beads, polyurethane foam particles and the like). The filler may also be a salt such as a halide salt. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metal fillers include, tin, lead, bismuth, cobalt, antimony, cadmium, iron titanium. Other miscellaneous fillers include sulfur, organic sulfur compounds, graphite and metallic sulfides and suspending agents.

An example of a suspending agent is an amorphous silica particle having a surface area less than 150 meters square/gram that is commercially available from DeGussa Corp., Rheinfelden, Germany, under the trade name "OX-50." The addition of the suspending agent can lower the overall viscosity of the abrasive slurry. The use of suspending agents is further described in U.S. Pat. No. 5,368,619 (Culler) incorporated hereinafter by reference.

Binders

The abrasive coating of this invention is formed from a curable abrasive composite layer that comprise a mixture of abrasive particles and precursor polymer subunits. The curable abrasive composite layer preferably comprises organic precursor polymer subunits. The precursor polymer subunits preferably are capable of flowing sufficiently so as to be able to coat a surface. Solidification of the precursor polymer subunits may be achieved by curing (e.g., polymerization and/or cross-linking), by drying (e.g., driving off a liquid) and/or simply by cooling. The precursor polymer subunits may be an organic solvent borne, a water-borne, or a 100% solids (i.e., a substantially solvent-free) composition. Both thermoplastic and/or thermosetting polymers, or materials, as well as combinations thereof, maybe used as precursor polymer subunits. Upon the curing of the precursor polymer subunits, the curable abrasive composite is converted into the cured abrasive composite. The preferred precursor polymer subunits can be either a condensation curable resin or an addition polymerizable resin. The addition polymerizable resins can be ethylenically unsaturated monomers and/or oligomers. Examples of useable crosslinkable materials include phenolic resins, bismaleimide binders, vinyl ether resins, aminoplast resins having pendant alpha, beta unsaturated carbonyl groups, urethane resins, epoxy resins, acrylate resins, acrylated isocyanurate resins, urea-formaldehyde resins, isocyanurate resins, acrylated urethane resins, acrylated epoxy resins, or mixtures thereof.

An abrasive composite layer may comprise by weight between about 1 part abrasive particles to 90 parts abrasive particles and 10 parts precursor polymer subunits to 99 parts precursor polymer subunits. Preferably, an abrasive composite layer may comprise about 30 to 85 parts abrasive particles and about 15 to 70 parts precursor polymer subunits. More preferably an abrasive composite layer may comprise about 40 to 70 parts abrasive particles and about 30 to 60 parts precursor polymer subunits.

The precursor polymer subunits are preferably a curable organic material (i.e., a polymer subunit or material capable of polymerizing and/or crosslinking upon exposure to heat and/or other sources of energy, such as electron beam, ultraviolet light, visible light, etc., or with time upon the addition of a chemical catalyst, moisture, or other agent which cause the polymer to cure or polymerize). Precursor polymer subunits examples include amino polymers or aminoplast polymers such as alkylated urea-formaldehyde polymers, melamine-formaldehyde polymers, and alkylated benzoguanamine-formaldehyde polymer, acrylate polymers including acrylates and methacrylates alkyl acrylates, acrylated epoxies, acrylated urethanes, acrylated polyesters, acrylated polyethers, vinyl ethers, acrylated oils, and acrylated silicones, alkyd polymers such as urethane alkyd polymers, polyester polymers, reactive urethane polymers, phenolic polymers such as resole and novolac polymers, phenolic/latex polymers, epoxy polymers such as bisphenol epoxy polymers, isocyanates, isocyanurates, polysiloxane polymers including alkylalkoxysilane polymers, or reactive vinyl polymers. The resulting binder may be in the form of monomers, oligomers, polymers, or combinations thereof.

The aminoplast precursor polymer subunits have at least one pendant alpha, beta-unsaturated carbonyl group per molecule or oligomer. These polymer materials are further described in U.S. Pat. No. 4,903,440 (Larson et al.) and U.S. Pat. No. 5,236,472 (Kirk et al.), both incorporated herein by reference.

Preferred cured abrasive coatings are generated from free radical curable precursor polymer subunits. These precursor polymer subunits are capable of polymerizing rapidly upon an exposure to thermal energy and/or radiation energy. One preferred subset of free radical curable precursor polymer subunits include ethylenically unsaturated precursor polymer subunits. Examples of such ethylenically unsaturated precursor polymer subunits include aminoplast monomers or oligomers having pendant alpha, beta unsaturated carbonyl groups, ethylenically unsaturated monomers or oligomers, acrylated isocyanurate monomers, acrylated urethane oligomers, acrylated epoxy monomers or oligomers, ethylenically unsaturated monomers or diluents, acrylate dispersions, and mixtures thereof. The term acrylate includes both acrylates and methacrylates.

Ethylenically unsaturated precursor polymer subunits include both monomeric and polymeric compounds that contain atoms of carbon, hydrogen and oxygen, and optionally, nitrogen and the halogens. Oxygen or nitrogen atoms or both are generally present in the form of ether, ester, urethane, amide, and urea groups. The ethylenically unsaturated monomers may be monofunctional, difunctional, trifunctional, tetrafunctional or even higher functionality, and include both acrylate and methacrylate-based monomers. Suitable ethylenically unsaturated compounds are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, or maleic acid. Representative examples of ethylenically unsaturated monomers include methyl methacrylate, ethyl methacrylate, styrene, divinylbenzene, hydroxyethyl acrylate, hydroxyethyl methacrylate, hydroxypropyl acrylate, hydroxy propyl methacrylate, hydroxybutyl acrylate, hydroxybutyl methacrylate, lauryl acrylate, octyl acrylate, caprolactone acrylate, caprolactone methacrylate, tetrahydrofurfuryl methacrylate, cyclohexyl acrylate, stearyl acrylate, 2-phenoxyethyl acrylate, isooctyl acrylate, isobomyl acrylate, isodecyl acrylate, polyethylene glycol monoacrylate, polypropylene glycol monoacrylate, vinyl toluene, ethylene glycol diacrylate, polyethylene glycol diacrylate, ethylene glycol dimethacrylate, hexanediol diacrylate, triethylene glycol diacrylate, 2-(2-ethoxyethoxy) ethyl acrylate, propoxylated trimethylol propane triacrylate, trimethylolpropane triacrylate, glycerol triacrylate, pentaerthyitol triacrylate, pentaerythritol trimethacrylate, pentaerythritol tetraacrylate and pentaerythritol tetramethacrylate. Other ethylenically unsaturated materials include monoallyl, polyallyl, or polymethallyl esters and amides of carboxylic acids, such as diallyl phthalate, diallyl adipate, or N,N-diallyladipamide. Still other nitrogen containing ethylenically unsaturated monomers include tris(2-acryloxyethyl)isocyanurate, 1,3,5-tri(2-methyacryloxyethyl)-s-triazine, acrylamide, methylacrylamide, N-methyl-acrylamide, N,N-dimethylacrylamide, N-vinylpyrrolidone, or N-vinylpiperidone.

A preferred precursor polymer subunits contains a blend of two or more acrylate monomers. For example, the precursor polymer subunits may be a blend of trifunctional acrylate and a monofunctional acrylate monomers. An example of one precursor polymer subunits is a blend of propoxylated trimethylol propane triacrylate and 2-(2-ethoxyethoxy) ethyl acrylate. The weight ratios of multifunctional acrylate and monofunctional acrylate polymers may range from about 1 part to about 90 parts multifunctional acrylate to about 10 parts to about 99 parts monofunctional acrylate.

It is also feasible to formulate a precursor polymer subunits from a mixture of an acrylate and an epoxy polymer, e.g., as described in U.S. Pat. No. 4,751,138 (Tumey et al.), incorporated herein by reference.

Other precursor polymer subunits include isocyanurate derivatives having at least one pendant acrylate group and isocyanate derivatives having at least one pendant acrylate group are further described in U.S. Pat. No. 4,652,274

(Boettcher et al.), incorporated herein by reference. The preferred isocyanurate material is a triacrylate of tris (hydroxyethyl) isocyanurate.

Still other precursor polymer subunits include diacrylate urethane esters as well as polyacrylate or poly methacrylate urethane esters of hydroxy terminated isocyanate extended polyesters or polyethers. Examples of commercially available acrylated urethanes include those under the tradename "UVITHANE 782," available from Morton Chemical, Moss Point, Miss.; "CMD 6600," "CMD 8400," and "CMD 8805," available from UCB Radcure Specialties, Smyrna, Ga.; "PHOTOMER" resins (e.g., PHOTOMER 6010) from Henkel Corp., Hoboken, N.J.; "EBECRYL 220" (hexafunctional aromatic urethane acrylate), "EBECRYL 284" (aliphatic urethane diacrylate of 1200 diluted with 1,6-hexanediol diacrylate), "EBECRYL 4827" (aromatic urethane diacrylate), "EBECRYL 4830" (aliphatic urethane diacrylate diluted with tetraethylene glycol diacrylate), "EBECRYL 6602" (trifunctional aromatic urethane acrylate diluted with trimethylolpropane ethoxy triacrylate), "EBECRYL 840" (aliphatic urethane diacrylate), and "EBECRYL 8402" (aliphatic urethane diacrylate) from UCB Radcure Specialties; and "SARTOMER" resins (e.g., "SARTOMER" 9635, 9645, 9655, 963-B80, 966-A80, CN980M50, etc.) from Sartomer Co., Exton, Pa.

Yet other precursor polymer subunits include diacrylate epoxy esters as well as polyacrylate or polymethacrylate epoxy ester such as the diacrylate esters of bisphenol A epoxy polymer. Examples of commercially available acrylated epoxies include those under the tradename "CMD 3500," "CMD 3600," and "CMD 3700," available from UCB Radcure Specialties.

Other precursor polymer subunits may also be acrylated polyester polymers. Acrylated polyesters are the reaction products of acrylic acid with a dibasic acid/aliphatic diol-based polyester. Examples of commercially available acrylated polyesters include those known by the trade designations "PHOTOMER 5007" (hexafunctional acrylate), and "PHOTOMER 5018" (tetrafunctional tetracrylate) from Henkel Corp.; and "EBECRYL 80" (tetrafunctional modified polyester acrylate), "EBECRYL 450" (fatty acid modified polyester hexaacrylate) and "EBECRYL 830" (hexafunctional polyester acrylate) from UCB Radcure Specialties.

Another preferred precursor polymer subunits is a blend of ethylenically unsaturated oligomer and monomers. For example the precursor polymer subunits may comprise a blend of an acrylate functional urethane oligomer and one or more monofunctional acrylate monomers. This acrylate monomer may be a pentafunctional acrylate, tetrafunctional acrylate, trifunctional acrylate, difunctional acrylate, monofunctional acrylate polymer, or combinations thereof.

The precursor polymer subunits may also be an acrylate dispersion like that described in U.S. Pat. No. 5,378,252 (Follensbee), incorporated herein by reference.

In addition to thermosetting polymers, thermoplastic binders may also be used. Examples of suitable thermoplastic polymers include polyamides, polyethylene, polypropylene, polyesters, polyurethanes, polyetherimide, polysulfone, polystyrene, acrylonitrile-butadiene-styrene block copolymer, styrene-butadiene-styrene block copolymers, styrene-isoprene-styrene block copolymers, acetal polymers, polyvinyl chloride and combinations thereof.

Water-soluble precursor polymer subunits optionally blended with a thermosetting resin may be used. Examples of water-soluble precursor polymer subunits include polyvinyl alcohol, hide glue, or water-soluble cellulose ethers such as hydroxypropylmethyl cellulose, methyl cellulose or hydroxyethylmethyl cellulose. These binders are reported in U.S. Pat. No. 4,255,164 (Butkze et al.), incorporated herein by reference.

In the case of precursor polymer subunits containing ethylenically unsaturated monomers and oligomers, polymerization initiators may be used. Examples include organic peroxides, azo compounds, quinones, nitroso compounds, acyl halides, hydrazones, mercapto compounds, pyrylium compounds, imidazoles, chlorotriazines, benzoin, benzoin alkyl ethers, diketones, phenones, or mixtures thereof. Examples of suitable commercially available, ultraviolet-activated photoinitiators have tradenames such as "IRGACURE 651," "IRGACURE 184," and "DAROCUR 1173" commercially available from Ciba Specialty Chemicals, Tarrytown, N.Y. Another visible light-activated photoinitiator has the trade name "IRGACURE 369" commercially available from Ciba Geigy Company. Examples of suitable visible light-activated initiators are reported in U.S. Pat. Nos. 4,735,632 (Oxman et al.) and U.S. Pat. No. 5,674,122 (Krech et al.)

A suitable initiator system may include a photosensitizer. Representative photosensitizers may have carbonyl groups or tertiary amino groups or mixtures thereof. Preferred photosensitizers having carbonyl groups are benzophenone, acetophenone, benzil, benzaldehyde, o-chlorobenzaldehyde, xanthone, thioxanthone, 9,10-anthraquinone, or other aromatic ketones. Preferred photosensitizers having tertiary amines are methyldiethanolamine, ethyldiethanolamine, triethanolamine, phenylmethyl-ethanolamine, or dimethylaminoethylbenzoate. Commercially available photosensitizers include "QUANTICURE ITX," "QUANTICURE QTX," "QUANTICURE PTX," "QUANTICURE EPD" from Biddle Sawyer Corp.

In general, the amount of photosensitizer or photoinitiator system may vary from about 0.01 to 10% by weight, more preferably from 0.25 to 4.0% by weight of the components of the precursor polymer subunits.

Additionally, it is preferred to disperse (preferably uniformly) the initiator in the precursor polymer subunits before addition of any particulate material, such as the abrasive particles and/or filler particles.

In general, it is preferred that the precursor polymer subunits be exposed to radiation energy, preferably ultraviolet light or visible light, to cure or polymerize the precursor polymer subunits. In some instances, certain abrasive particles and/or certain additives will absorb ultraviolet and visible light, which may hinder proper cure of the precursor polymer subunits. This occurs, for example, with ceria abrasive particles. The use of phosphate containing photoinitiators, in particular acylphosphine oxide containing photoinitiators, may minimize this problem. An example of such an acylphosphate oxide is 2,4,6-trimethylbenzoyldiphenylphosphine oxide, which is commercially available from BASF Corporation, Ludwigshafen, Germany, under the trade designation "LUCIRIN TPO-L." Other examples of commercially available acylphosphine oxides include "DAROCUR 4263" and "DAROCUR 4265" commercially available from Ciba Specialty Chemicals.

Cationic initiators may be used to initiate polymerization when the binder is based upon an epoxy or vinyl ether. Examples of cationic initiators include salts of onium cations, such as arylsulfonium salts, as well as organometallic salts such as ion arene systems. Other examples are reported in U.S. Pat. No. 4,751,138 (Tumey et al.); U.S. Pat. No. 5,256,170 (Harmer et al.); U.S. Pat. No. 4,985,340

(Palazzotto) and U.S. Pat. No. 4,950,696, all incorporated herein by reference.

Dual-cure and hybrid-cure photoinitiator systems may also be used. In dual-cure photoiniator systems, curing or polymerization occurs in two separate stages, via either the same or different reaction mechanisms. In hybrid-cure photoinitiator systems, two curing mechanisms occur at the same time upon exposure to ultraviolet/visible or electron-beam radiation.

Backing

The substrate may be any of a variety of perforated solid elastomeric sheet or foam sheet materials that are suitable for the abrasive article made in accordance with the present invention. Examples include solid elastomer sheets and open cell foams, closed cell foams and combinations thereof.

The backing may be laminated to other sheet materials, for example, for reinforcement, or to apply one part of a two-part attachment system. For example, a reinforcing fabric may be applied to surfaces 18 of the abrasive product to provide tear resistance to the abrasive product. Additionally, one part of a two-part mechanical attachment system may be applied to a surfaces 18 such as a loop fabric having engaging loops on its surface for attachment for either hooks contained on the surface to which it is to be attached, or stems having flattened distal ends which likewise may be contained on the surface to which the abrasive product is to be applied. Additional information on suitable loop fabrics may be found in U.S. Pat. No. 4,609,581 (Ott) and U.S. Pat. No. 5,254,194 (Ott), both being incorporated herein by reference. Alternatively, the backing may be a sheet like structure having engaging hooks protruding from the opposite second major surface. Examples of such sheet like structures with engaging hooks may be found in U.S. Pat. No. 5,505,747 (Chesley), U.S. Pat. No. 5,667,540 (Chesley), U.S. Pat. No. 5,672,186 (Chesley), and U.S. Pat. No. 6,197,076 (Braunschweig), all being incorporated herein by reference. Any sheet materials attached to surfaces 21 may be perforated to permit the passage of debris.

EXAMPLES

The following non-limiting examples will further illustrate the invention. All parts are by weight percent unless otherwise indicated.

Glossary of Terms

A-174

γ-methacryloxypropyltrimethoxy silane, trade designation "SILQUEST A-174," available Crompton Corp., Friendly, W.Va.

ALODUR FRPL ANSI

Grade 60 mineral, a general purpose, semi-friable fused aluminum oxide mineral available under the trade designation ALODUR FRPL 60 manufactured by Treibacher Schleifmittel AG (Seebach 2, Postfach 1, A-9523 Villach, Austria).

Aluminum Oxide—$Al_2O_3$

General purpose, regular brown fused aluminum oxide mineral, ANSI grade 120.

Ammonium Hydroxide Solution (28% by weight $NH_3$)

Serves as an activator for the EZ-3 solution.

BB077

BB077 is the trade designation of a water-borne (70% solids in water) resole phenolic resin available from Neste Resins Canada, a Division of Neste Canada Inc., Mississauga, Ontario.

CARBOPOL EZ-3

CARBOPOL EZ-3 is the trade designation of a polyacrylic acid available from BF Goodrich which serves as a viscosity control.

SD1010

SD1010 is the trade designation for triarylsulfonium hexafluorantimonate cationic photoinitiator, 50 wt % in propylene carbonate, from Sartomer Company Inc., Exton, Pa.

ERL 4299

ERL 4299 is the trade designation for a bis-3,4 hexyl methyl cycloaliphatic epoxy from Dow Chemical, Midland, Mich.

ERL 4221

ERL 4221 is the trade designation for a cycloaliphatic epoxy resin from Dow Chemical, Midland, Mich.

GC2500 green silicon carbide mineral, grade JIS2500, available from Fujimi Corp., Elmhurst, Ill.

HYCAR 2679

HYCAR 2679 is the trade designation for an acrylic emulsion available from BF Goodrich, Cleveland, Ohio.

IRGACURE 651

IRGACURE 651 is the trade designation for 2,2-dimethoxy-1,2-diphenyl- 1-ethanone free radical photoinitiator from Ciba Corporation, Hawthorne, N.Y.

Maroon Pigment

Violet 19, inorganic pigment dispersion (70% solids in water), manufactured by Sun Chemical.

PD9000 anionic polyester dispersant, trade designation "ZEPHRYM PD 9000," available from Uniqema, Wilmington, Del.

SR339

2-phenoxyethyl acrylate from Sartomer, Inc., Exton, Pa.

SILWET L-77

SILWET L-77 is the trade designation for an organosilicone surfactant to promote wetting available from OSI Specialties, Friendly, W.Va.

SYNFAC 8009

SYNFAC 8009 is the trade designation for a polyether polyol available from Milliken Chemicals, Spartanburg, S.C.

TMPTA

TMPTA is the trade designation of a trimethylolpropanetriacrylate crosslinking aid available from Sartomer Company Inc., Exton, Pa.

TPO-L phosphine oxide, trade designation "LUCIRIN TPO-L," available from BASF Chemicals, Ludwigshafen, Germany.

Example 1

A water borne acrylic make coat adhesive precursor, "Formulation M-1," was made by mixing; 90.1% HYCAR 2679, 8.0% Water, 0.09% EZ-3 solution, 0.09% Ammonium Hydroxide solution, 0.22% SILWET L-77 and 1.5% maroon pigment from Sun Chemicals in a suitable size baffled vessel with a high shear mixer. The water served as a diluent. The resulting mixture had a viscosity of 2300 cps (BROOKFIELD Model DV-I viscometer, spindle No. 3, rotated at 20 RPM at 20° C.) and percent solids of 45%.

A 30 cm by 30 cm square of flexible Substrate A was weighed to determine its basis weight for further processing.

Substrate A was a 3 mm thick open mesh, resilient, non-slip matting made from scrim reinforced polyvinyl chloride foam. Substrate A was identified under the trade designation Black Polyester-PVC Perforated Foam, available from McMaster-Carr as catalog #85695K31. The individual resilient bodies were approximately 4 mm wide and 4.6 mm long. Each body had a slightly hemispherical domed upper surface shape. Approximately 68% of the surface was composed of solid material with the remaining 32% being void space. Products similar to this were manufactured by Griptex Industries, Inc., Cartersville, Ga.

The make coat precursor (Formulation M-1) was spray coated onto the upper surface of flexible-sheet like substrate A. Spray coating was by using a hand held conventional high-pressure paint spray gun manufactured by Campbell Hausfeld. The dry add-on weight was 211 g/m$^2$.

ALODUR FRPL grade 60 mineral abrasive particles were then evenly applied to the wet surface by sifting the particles saltshaker style from ajar that had small holes in the lid. The dry add-on weight of the abrasive particles was 464 g/m$^2$. The mineral coated composite was placed in a pre-heated forced air oven and allowed to cure at 120° C. for 10 minutes. The sample was removed from the oven and allowed to cool to room temperature.

A water borne phenolic size coat adhesive precursor, "Formulation S-1," was made by mixing; 57.2% Phenolic BB-077, 42.7% Water, 0.10% SILWET L-77 in a suitable size baffled vessel with a high shear mixer. The resulting mixture had a viscosity of 200 cps (BROOKFIELD Model DV-I viscometer, spindle No. 3, rotated at 20 RPM at 20° C.) and percent solids of 40%. The size coat precursor was sprayed on the make and mineral coated substrate with a hand held conventional high-pressure paint spray gun. The dry add-on weight was 21 g/m$^2$. The size coated sample was placed in a pre-heated forced air oven and allowed to cure at 120° C. for 10 minutes.

The completed sample was removed from the oven and allowed to equilibrate to room temperature conditions before testing.

Example 2

A 30 cm by 30 cm square of flexible sheet substrate B was weighed to establish its basis weight for further testing. Substrate B was a 5 mm thick open mesh, resilient, non-slip matting made from scrim reinforced poly vinyl chloride foam. The individual "resilient bodies" were approximately 9 mm wide and 9 mm long. Each body had a slightly hemispherical domed shape. Approximately 57% of the surface area was composed of solid material with the remaining 43% being void space. Products similar to this were manufactured by MSM Industries, Smyrna, Tenn.

A water borne make coat adhesive precursor, "Formulation M-1," was made as in Example 1. The make coat precursor was spray coated over the first surface of substrate B. Spray coating was by using a hand held conventional high-pressure paint spray gun manufactured by Campbell Hausfeld. The sample had a dry add-on weight of 190 g.m$^2$.

ALODUR FRPL grade 60 mineral abrasive particles were then evenly applied to the wet surface with a sandblaster gun (a hand held, siphon fed spot sandblasting gun manufactured by Speed Air Corporation). The dry add-on weight of the abrasive particles was 375 g/m$^2$. The mineral coated composite was placed in a pre-heated forced air oven and allowed to cure at 120° C. for 10 minutes. The sample was removed from the oven and allowed to cool to room temperature.

A water-borne size coat adhesive precursor, "Formulation S-1," was made as in Example 1. The size coat precursor was sprayed on the make and mineral coated substrate with a hand held conventional high-pressure paint spray gun. The dry add-on weight was 23 g/m$^2$. The size coated sample was placed in a pre-heated forced air oven and allowed to cure at 120° C. for 10 minutes.

The completed sample was removed from the oven and allowed to equilibrate to room temperature conditions before testing.

Example 3

A cycloaliphatic epoxy and polyol mixture make coat adhesive precursor, "Formulation M-2," was made by mixing; 58.8% ERL4299, 39.2% SYNFAC 8009, 2.0% SD1010 in a suitable size baffled vessel with a high shear mixer. The resulting mixture had a viscosity of 2500 cps (BROOKFIELD Model DV-I viscometer, spindle No. 3, rotated at 20 RPM at 20° C.) and percent solids of 100%.

A 15 cm×60 cm flexible sample of Substrate A was weighed to determine its basis weight for further processing.

The make coat precursor was applied using a small two roll roll-coater to the flexible-sheet like substrate A. This roll-coater was a standard two-roll type equipped with a 15 cm (6-inch) diameter rubber covered bottom roll and a 7.6 cm (3-inch) diameter polished steel top roller. The bottom roller was fitted with a doctor blade for adhesive metering purposes. Sample was weighed to determine the dry add-on weight which was 132 g/m$^2$.

Aluminum Oxide grade 120 mineral abrasive particles were then evenly applied to the wet surface with a sandblaster gun as in Example 2. The dry add-on weight of the abrasive particles was 337 g/m$^2$.

Formulation M-2 was cured using a UV light chamber. A conveyer belt for moving the coated sample through the UV light chamber was adjusted to 10 meter/minute. This UV light chamber was a Fusion Systems model F300—15 cm (6-inch) medium pressure mercury lamp. Its input power was 118 watts/cm (300 watts/inch) and output power was 250 mJ/cm$^2$ of UVA radiation (300–400 nm) at 10 meter/minute. The chamber was fitted with a 15 cm (6 inch) wide conveyor system to transport the sample under the light source. The mineral coated composite was placed on the conveyer and the sample was exposed to UV radiation as the sample passed through the light chamber to provide total light exposure of 1,000 mJ/cm$^2$.

An cycloaliphatic epoxy size coat adhesive precursor, "Formulation S-2," was made by mixing; 67.90% ERL 4221, 29.10% TMPTA, 2.00% SD 1010 and 1.00% of IRGACURE 651 in a suitable size baffled vessel with a high shear mixer. The resulting mixture had a viscosity of 250 cps (measured as described in Example 1) and percent solids of 100%. The size coat precursor was sprayed on the make and mineral coated substrate with a hand held conventional high-pressure paint spray gun. The sample was weighed and the size weight recorded. The dry add-on weight was 18.5 g/m$^2$.

The size coated sample was placed on the conveyer of the UV light chamber and exposed to UV radiation as the sample passed through the light chamber with a total light exposure of 1,000 mJ/cm$^2$.

The completed samples were allowed to equilibrate to room temperature conditions before testing.

Testing Procedures

Finish Testing

"Surface Finish" is a measure of the character of the scratches created by the abrasive on the workpiece. They are numerically indicated by the roughness number of depths as measured by a profilometer. This scratch/finish measurement instrument was a PERTHOMETER model M4P Surface Measuring and Recording Instrument manufactured by Feinpruf Perthen GmbH. The numbers generated are termed $R_a$, $R_z$ and $R_{max}$.

$R_a$ is the average roughness (DIN 4768)—the arithmetic mean of the roughness profile within the total measurement length (2.54 mm).

$R_z$ is the average roughness depth (DIN 4768)—the mean of the individual roughness depths. The average of the vertical distance between the highest and lowest points in the roughness profile.

$R_{max}$ is the maximum Roughness Depth (DIN 4768)—the greatest individual roughness depth occurring over the measurement distance.

The workpiece used in these tests are plastic panels, 6 cm×122 cm PLEXIGLAS plastic sheets.

A fixture to support the abrasive test sample was used which was a 4.54 kilogram block of brass fitted with a 60 cm long articulated handle.

A 5.71 cm×10.2 cm abrasive test sample was adhered to the sanding fixture with double sided adhesive tape. Using this test sample fixture, the plastic panel workpiece was sanded for ten cycles to establish the initial scratch pattern for measurement. One cycle was complete when the test fixture with attached sample is pushed the length of the panel then pulled back to the starting point (a total of 144 cm of linear travel).

The surface roughness of the sanded portion of the plastic panel was measured with a PERTHOMETER model M4P. The results are recorded below in Table 1.

This entire procedure was repeated with fresh test panels for each abrasive product type evaluated.

Cut Testing "Cut-rate" refers to the ability of the abrasive to remove stock material or surface particles from the workpiece. The "cut rate" is the amount of weight loss of the workpiece.

The workpiece was a painted panel. It was 61 cm×122 cm medium density fiberboard panel painted with three coats (127 μm (5 mils) wet) of Sherwin Williams latex paint available under the trade designation STYLE PERFECT INTERIOR.

A fixture to support the abrasive test sample was used which was a 4.54 kilogram block of brass fitted with a 60 cm long articulated handle. A 5.71 cm×10.2 cm abrasive test sample was adhered to the sanding fixture with double-sided adhesive tape.

The painted panel workpiece was weighed with an accurate electronic balance before the paint-sanding test began. Using the sample test fixture the painted panel was sanded for a total of 50 cycles. Every 10 cycles during the sanding test the painted panel and the test fixture sample were cleaned of accumulated sanding dust by blowing with compressed air. The painted panel was re-weighed to establish the weight loss (cut) during the 10 cycle sanding process. The cumulative weight loss for each 10 cycle test was recorded below up to a total of 50 cycles.

This entire procedure was repeated with fresh test panels for each abrasive product type evaluated.

Example 4

This example describes the comparative finish testing of Example No. 3 flexible abrasive sample of the present invention to two standard products: Conventional Sandpaper which was identified under the trade designation as 120-grit PRODUCTION C wt. Open Coat Aluminum Oxide sandpaper 230N manufactured by Minnesota Mining and Manufacturing Company (3M) and Conventional Sanding Sponge which was identified under the trade designation as a SMALL AREA SANDING SPONGE Extra Fine/Fine (120 grit aluminum oxide) Catalog #907 manufactured by 3M. Procedure as described above was allowed. Results are summarized in Table 1.

TABLE 1

Scratch Finish Results (micrometers)

| | $R_a$ | $R_z$ | $R_{max}$ |
|---|---|---|---|
| Example #3 | 0.08 | 0.94 | 1.24 |
| Conventional Sanding Sponge | 0.10 | 1.68 | 2.67 |
| Conventional Sandpaper | 0.30 | 4.24 | 5.41 |

Example 5

This example describes the comparative cut testing of Example No. 3 flexible abrasive sample of the present invention to two standard products: Conventional sandpaper which was identified under the trade designation as 120-grit PRODUCTION C wt. OPEN COAT ALUMINUM OXDE sandpaper 230N manufactured by 3M and Conventional Sanding Sponge which was identified under the trade designation as a SMALL AREA SANDING SPONGE Extra Fine/Fine (120 grit aluminum oxide) Catalog #907 manufactured by 3M. Procedure as described above was followed. Results are summarized in Table 2.

TABLE 2

Paint Sanding Results
Cumulative Weight Loss (grams)

| Cycles | Example #3 | Conventional Sanding Sponge | Conventional Sandpaper |
|---|---|---|---|
| 10 | 0.56 | 0.63 | 0.38 |
| 20 | 0.99 | 1.02 | 0.77 |
| 30 | 1.31 | 1.28 | 1.09 |
| 40 | 1.54 | 1.49 | 1.45 |
| 50 | 1.90 | 1.61 | 1.74 |

The results of the paint removal testing and scratch/finish testing demonstrate that the flexible sanding product, Example No. 3 of the current invention provides, both improved cut and improved scratch finish when compared with conventional sandpaper or conventional sanding sponges.

Example 6

This example describes the preparation of a structured abrasive coating on a flexible abrasive product that may include a second surface which is one part of a two-part mechanical attachment system.

Pre-Mix #1: 33.6 parts SR339 was mixed by hand with 50.6 parts TMPTA, into which 8 parts PD 9000 was added and held at 60° C. until dissolved. The solution was cooled to room temperature. To this was added 2.8 parts TPO-L and 5 parts A-174 and the mixture again stirred until homogeneous.

Slurry #1: 61.5 parts GC2500 was incorporated into 38.5 parts of pre-mix #1 using the DISPERSATOR mixer to form homogeneous slurry #1.

The rubber scrim backing described in Example 1 as Substrate A was spray-coated with HYCAR 2679 resin precursor to achieve a coatweight of 1.0 gram/155 $cm^2$ after drying at 93° C. for 45 minutes.

Slurry #1 was knife coated onto a polypropylene tool made from a roller depicted in FIGS. 4–6 wherein: s=55 $\mu$m; t=250 $\mu$m; w=99.53°; x=54.84 $\mu$m; z=53.00°. The coated tool was then laminated to the rubber scrim and given a single pass in the UV processor using a D-bulb at 236 W/cm (600 W/inch) exposure, at a web speed of 9.1 m/min. (30 ft/min.) and a nip pressure of 344 kPa (50 psi), after which the tooling was removed to reveal a structured abrasive coating on top of the rubber scrim.

It will be apparent to those of ordinary skill in the art that various changes and modifications may be made without deviating from the inventive concept set forth above. Thus, the scope of the present invention should not be limited to the structures described in this application, but only by the structures described by the language of the claims and the equivalents of those structures.

What is claimed is:

1. A flexible abrasive product comprising a. a flexible sheet substrate comprising a multiplicity of separated resilient bodies connected to each other in a generally planar array in a pattern which provides open spaces between adjacent connected bodies, each body having a first surface and an opposite second surface; and b. abrasive particles on at least said first surface to provide an abrasive surface.

2. The flexible abrasive product of claim 1 having a thickness measured between said first surface and said second surface of at least one millimeter.

3. The flexible abrasive product of claim 1 wherein said substrate includes a scrim which provides a structure which supports and connects said separated resilient bodies.

4. The flexible abrasive product of claim 1 wherein said substrate has an open space in the range of about 20% to 80%.

5. The flexible abrasive product of claim 1 wherein said resilient bodies are generally square.

6. The flexible abrasive product of claim 1 wherein said first surfaces of said resilient bodies are convex surfaces.

7. The flexible abrasive product of claim 1 wherein said first and second surfaces are abrasive surfaces.

8. The flexible abrasive product of claim 7 wherein said abrasive surfaces comprise different abrasive properties.

9. The flexible abrasive product of claim 1 wherein said abrasive particles are in a binder coating applied to said first surface.

10. The flexible abrasive product of claim 9 wherein the abrasive coating has a shaped abrasive surface comprising raised areas and depressed areas.

11. The flexible abrasive product of claim 1 wherein said abrasive surface comprises a binder make coating into which at least a portion of each abrasive particle is embedded.

12. The flexible abrasive product of claim 11 wherein the make coating is a binder selected from the group consisting of acrylate resins, epoxy resins, ethylenically unsaturated resins, nitrile rubber resins, urethane resins, aminoplast resins, acrylated isocyanurate resins, isocyanurate resins, acrylated urethane resins, acrylated epoxy resins, phenolic resins, urea-formaldehyde resins, polyvinyl chloride resins, butadiene rubber resins, and combinations thereof.

13. The flexible abrasive product of claim 11 further including a size coating over said make coating and said abrasive particles.

14. The flexible abrasive product of claim 13 wherein the size coating is a binder resin selected from the group consisting of phenolic resins, aminoplast resins having pendant $\alpha,\beta$-unsaturated carbonyl groups, urethane resins, epoxy resins, ethylenically unsaturated resins, acrylated isocyanurate resins, urea formaldehyde resins, isocyanurate resins, acrylated urethane resins, acrylated epoxy resins, bis-maleimide resins, fluorene-modified resins, and combinations thereof.

15. The flexible abrasive product of claim 1 wherein said abrasive particles comprise material selected from the group consisting of fused aluminum oxide, heat treated aluminum oxide, silicon carbide, alumina-based ceramics, zirconia, alumina-zirconia, diamond, ceria, cubic boron nitride, garnet, ground glass, quartz, titanium diboride and combinations thereof.

16. The flexible abrasive product of claim 1 wherein each of said resilient bodies have a size and shape that is substantially uniform.

17. The flexible abrasive product of claim 1 wherein said resilient bodies have a size of about 2 to about 25 millimeters.

18. The flexible abrasive product of claim 3 wherein said scrim includes a plurality of adjacent openings wherein resilient bodies are located in alternate openings with adjacent openings being devoid of resilient bodies to provide multiple openings through the abrasive product.

19. The flexible abrasive product of claim 3 wherein said scrim comprises a first set of rows of separated fibers deployed in a first direction and a second set of fibers deployed in a second direction to provide a grid including multiple adjacent openings wherein resilient bodies are located in alternate openings with openings between resilient bodies being devoid of resilient bodies.

20. The flexible abrasive product of claim 19 wherein alternate openings include a fibrous substructure upon which said resilient bodies are supported.

21. The flexible abrasive product of claim 3 wherein said scrim comprises an open mesh selected from the group consisting of woven or knitted fiber mesh, synthetic fiber mesh, natural fiber mesh, metal fiber mesh, molded thermoplastic polymer mesh, molded thermoset polymer mesh, perforated sheet materials, slit and stretched sheet materials and combinations thereof.

22. The flexible abrasive product of claim 1 wherein said resilient bodies comprise a foam material.

23. The flexible abrasive product of claim 1 wherein flexible substrate is formed from a material selected from a group consisting of polyvinyl chloride, ethylene vinyl acetate, polyurethane, foam rubber and silicone rubber.

24. The flexible abrasive product of claim 1 wherein said resilient bodies comprise polyvinylchloride foam.

25. The flexible abrasive product of claim 1 having a shape adapted to be held by hand for sanding contoured and complex surfaces.

26. The flexible abrasive product of claim 1 further including on said second surface one part of a two-part mechanical attachment system.

27. The flexible abrasive product of claim 26 wherein said one part of said two-part mechanical attachment system is selected from the group consisting of a hook part and a loop part of a hook and loop mechanical fastening system.

28. The flexible abrasive product of claim 26 wherein said one part of said two-part mechanical attachment system is selected from a flattened stem part and a loop part of a mechanical fastening system including a flattened stem part and a loop part.

29. The flexible abrasive product of claim 26 wherein said one part of said two-part attachment system is selected from a pressure sensitive adhesive coated sheet and an attachment surface for said pressure sensitive adhesive coated sheet of a fastening system including a pressure sensitive adhesive coated sheet and an attachment surface for said sheet.

30. A method of making a flexible abrasive product comprising a. providing a flexible sheet substrate comprising a multiplicity of separated resilient bodies connected to each other in a generally planar array in a pattern which provides open spaces between adjacent connected bodies, each body having a first surface and an opposite second surface; and b. providing abrasive particles on at least said first surface to provide an abrasive surface.

31. The method of claim 30 wherein said abrasive surface is provided by:

a. coating said first surface with a make coating of curable binder composition;

b. depositing abrasive particles onto the make coating of the curable composition; and c. at least partially curing the make coating composition.

32. The method of making a flexible abrasive product of claim 31 further including coating the make coating and abrasive particles with a size coating of a curable binder composition and curing the size coating composition.

33. The method of claim 30 wherein said abrasive particles are coated on said first surface by mixing abrasive particles with a curable binder composition to provide a mixture which cures to provide an abrasive coating, coating said first surface with the mixture and curing the curable binder composition.

34. The method of claim 33 wherein, after coating but prior to curing the curable binder composition containing abrasive particles, the coating is contacted with a surface of a tool which includes raised areas and depressed areas to provide a shaped surface to the abrasive coating.

35. The flexible abrasive product of claim 1 wherein said abrasive particles comprise the same grade size.

36. The flexible abrasive product of claim 1 wherein said abrasive particles comprise a mixture of different abrasive grade sizes.

37. The flexible abrasive product of claim 9 wherein said binder coating comprises a cured cycloaliphatic epoxy resin.

38. The flexible abrasive product of claim 37 wherein said cycloaliphatic epoxy resin is bis-3,4 hexyl methyl cycloaliphatic epoxy resin.

39. The flexible abrasive product of claim 1 wherein said separated resilient bodies are connected to each other with an inherently flexible joint.

* * * * *